United States Patent [19]

Williams

[11] Patent Number: 4,716,842

[45] Date of Patent: Jan. 5, 1988

[54] EXTRACTION ZONE FOR SOLID FUEL BURNER

[76] Inventor: Paul D. Williams, 2 Parkhill Road, Haumoana, New Zealand

[21] Appl. No.: 797,885

[22] Filed: Nov. 14, 1985

[30] Foreign Application Priority Data

Nov. 19, 1984 [NZ] New Zealand ..... 210243

[51] Int. Cl.[4] ..... F23B 5/00; F23B 7/00

[52] U.S. Cl. ..... 110/211; 110/214; 110/315; 110/316

[58] Field of Search ..... 110/210, 211, 214, 248, 110/254, 256, 315, 316

[56] References Cited

U.S. PATENT DOCUMENTS

| | | | |
|---|---|---|---|
| 34,714 | 3/1862 | Ekin | 110/316 |
| 265,348 | 10/1882 | Touragin | 110/316 |
| 3,043,247 | 7/1962 | Herbert et al. | 110/211 |
| 3,610,179 | 10/1971 | Shaw, Jr. | 110/214 |
| 3,678,869 | 7/1972 | Bowman | 110/214 |
| 4,123,979 | 11/1978 | Tesch | 110/214 |
| 4,379,433 | 4/1983 | Hoskinson | 110/214 |
| 4,441,436 | 4/1984 | Hayashi | 110/316 |
| 4,449,460 | 5/1984 | Bela et al. | 110/214 |
| 4,471,702 | 9/1984 | McKinlay | 110/315 |
| 4,484,530 | 11/1984 | Goetzman | 110/214 |
| 4,538,529 | 9/1935 | Temelli | 110/214 |
| 4,545,360 | 10/1985 | Smith et al. | 110/315 |
| 4,562,777 | 1/1986 | Vander Voort | 110/315 |

FOREIGN PATENT DOCUMENTS 208316 11/1984 Japan ..... 110/316

*Primary Examiner*—Henry C. Yuen

*Attorney, Agent, or Firm*—Tilton, Fallon, Lungmus & Chestnut

[57] ABSTRACT

A solid fuel burner 1 has a first chamber 2 for receiving a combustible fuel to be gasified and a substantially conical upwardly directed extraction zone connecting a bottom portion of the primary chamber 2 with a secondary chamber 8 through the apex region 42. The combustible fuel presents a relatively large surface area G into the extraction zone F and relatively low velocity gases can leave the primary combustion chamber 2 to maximize the extraction of gaseous fuel from the fuel while leaving fuel and other particulate material behind. The substantially conical shape of the extraction zone F which provides a convergent gas flow path does however enable a sufficiently high velocity or the hot gas entering into the secondary chamber 8. A transverse entry of cold air H by means of a tuyere assembly 46 is provided at the apex region 42. The high density of the cold air and its transverse flow ensures a good mixing of the cold air with the hot gas before its entry into the secondary chamber 8. The hot gas in the chamber 8 has a circular motion creating a vortex in the center of the chamber 8. Hot gas leaves the chamber 8 from one side at outlet 9 while cold air flows into the chamber 8 from an opposite side.

6 Claims, 6 Drawing Figures

EXTRACTION ZONE FOR SOLID FUEL BURNER

BACKGROUND OF THE INVENTION

This invention relates to an extraction zone for a solid fuel burner, In particular, but not exclusively, to a solid fuel burner of the type where a primary chamber receives a solid fuel which can be of any type such as wood, biomass such as straw, coconut shell or husk, briquetted sawdust, bark chips, wood logs or billets for example. The solid fuel is gasified by a controlled combustion in the primary chamber and the resulting gas is received, and further combusted, in a secondary combustion chamber which produces a high temperature gas exhaust which can be used for any suitable heating purpose. The extraction zone of the present invention connects the above mentioned primary and secondary chambers.

Such solid fuel burners with which the present invention can be used are suitable for a variety of purposes. These may be; direct heat applications in the heating and drying of agricultural produce such as tea, coffee, cocoa, copra, grain; industrial heating applications such as the heating of glasshouses, kilns and industrial premises; indirect heating applications such as the heating of heat exchange tubes of a heat exchanger or the heating of water or any other medium also by means of an appropriate heat exchanger.

In many instances such solid fuel burners can be used efficiently as a replacement for, or conversion of, existing diesel, electric or gas fired systems.

To the present time, solid fuel burners of this type have had problems in achieving an efficient transfer of gas from the primary chamber to the secondary chamber. This is particularly due to the ducting connecting the primary chamber to the secondary chamber being provided in the past typically by a number of transverse tubes extending across the bottom end of the primary chamber through which the heated gasified fuel has needed to pass in reaching the secondary chamber. However, the fuel within the primary chamber has tended to block off these transverse tubes and in so doing has constrained the entry of the gasified fuel into the secondary chamber. Also, fuel and particulate matter has tended to be drawn into the secondary chamber. This increases the likelihood of sparks being produced in the secondary chamber exhaust and causing problems particularly where the hot gas is used for drying purposes in explosive dusty situations.

Moreover, in previous types of burners a large quantity of induced draught was required at a large velocity. This resulted in "slagging" of the refractory material in the burner, i.e. the depositing of matèrial on the refractory material, thus closing off the gas flow paths in a relatively short period of time.

It is thus an object of the present invention to provide an extraction zone between the primary and secondary chambers of a solid fuel burner which can achieve an efficient transfer of gasified fuel between these chambers and which overcomes or at least obviates the problems associated with such transfer in existing types of solid fuel burners.

Further objects of the present invention will become apparent from the following description.

SUMMARY OF THE INVENTION

According to one aspect of the present invention there is thus provided a burner having a first chamber for receiving a combustible fuel to be gasified and a secondary chamber to receive the gasified fuel from the primary chamber and in which secondary chamber the gasified fuel is further combusted, characterised in a substantially conical and upwardly directed extraction zone providing a convergent gas flow path between a bottom portion of said primary chamber and said secondary chamber, an apex region of said extraction zone being substantially open and leading into said secondary chamber, an exit for hot gas being provided for said secondary chamber.

Further aspects of this invention which should be considered in all its novel aspects will become apparent from the following description given by way of example of possible embodiments of the invention and in which reference is made to the accompanying drawings.

DETAILED DESCRIPTION OF ILLUSTRATED EMBODIMENTS

Figure 1:
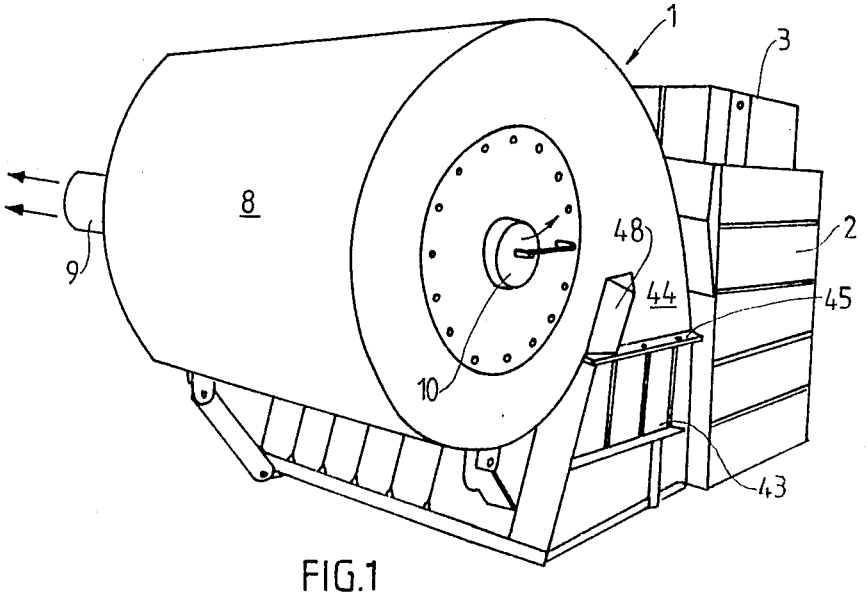
FIG. 1: is a diagrammatic illustration of a solid fuel burner according to the present invention showing a side perspective view of the solid fuel burner with the primary chamber at the back of the Figure connected via an intermediate extraction chamber of the present invention with the secondary combustion chamber.

Referring firstly to FIGS. 1 to 4 of the accompanying drawings, a solid fuel burner according to one possible embodiment of the invention is shown very diagrammatically and referenced generally by arrow 1. The burner 1 is shown having a primary combustion chamber 2 with an upper removable but sealed lid 3 through which fuel can be introduced into the primary combustion chamber 2. The fuel may be of any suitable type such as that referred to previously. As the fuel descends into the chamber 2 it passes through various changes in state and temperature.

In the region A of the chamber 2, the fuel would have just been introduced into the chamber 2 either manually or by an automatic mechanical loading system for example. The fuel may here be reaching temperatures in excess of 100° C. As the fuel reaches region B of chamber 2 it will be releasing gases, liquids, steams and tars. As the fuel approaches region C it may be at a temperature of approximately 500° C. In region C, the fuel will carbonise and become charcoal as it reaches temperatures which may be approximately 600° C.

In region D the fuel will oxidise giving a gaseous mixture of carbon dioxide, hydrogen and oxygen as the fuel reaches a temperature which may be approximately 600° C. to 1200° C.

As the fuel reaches the bottom of the chamber 2 towards the region E it will be reduced to ash and the carbon dioxide will be reduced to carbon monoxide. The hot gases will then enter the gaseous fuel outlet and extraction zone F at a temperature which may be approximately 600° C. to 1200° C. The gaseous mixture at this stage will generally comprise a combination of carbon monoxide, hydrogen, methane, carbon dioxide and nitrogen.

The above temperatures must be largely approximate as they will largely depend on the fuel used and its moisture content.

To control the primary and subsequent secondary combustion, air is drawn into the burner 1. For this purpose a side of the chamber 2 is shown provided with a jacket 5 through which air, illustrated by arrows, is shown passing and being pre-heated prior to entry into the chamber 2. Air valves 6 and 7 are shown, which may be automatically controlled, to control the flow of air into the chamber 2. The bottom air valve(s) 7 may be associated with a removable door assembly whereby ash can be removed from the bottom of the burner in zone E. A further ash door 40 may be provided as shown in outline in the bottom region of the extraction zone F.

Figure 2:
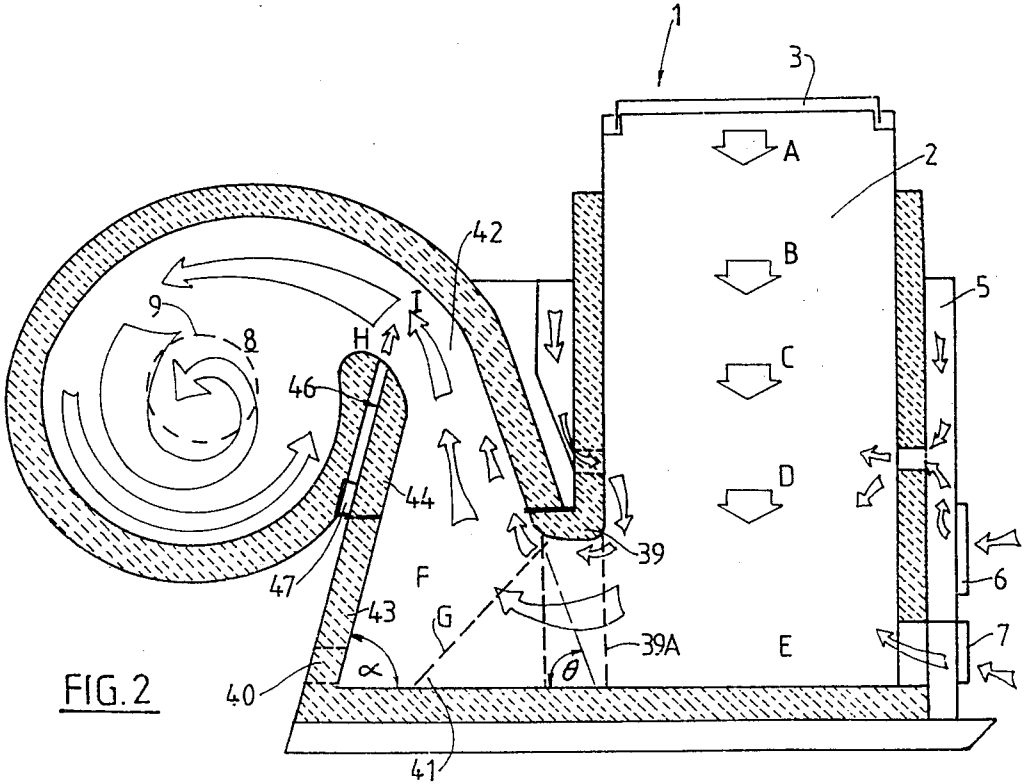
FIG. 2: shows very diagrammatically a cross-sectional view through the solid fuel burner of FIG. 1.

Further inlet ducts are shown on the left-hand side of chamber 2 in FIG. 2 through which suitable gases, such as for example steam, carbon dioxide or air, may be caused to flow as shown by the arrows. This gas will wash over the refractory material about the region 39 so as to prevent excessive refractory temperature and to protect the refractory material. If carbon dioxide is the gas used this will reduce to carbon monoxide within the chamber 2. As this reduction is an endothermic reaction this has the effect of reducing the temperature and cooling the refractory material to enhance the protective effect.

It is mentioned that a refractory material lining will generally be provided for most of the inner surfaces of the burner 1. As will be appreciated hereinafter, in some parts of the burner 1 the refractory material will be formed so as to define a specific shape or part of the burner 1. In the case of region 39 the refractory material may form, or assist in the formation of, an archway indicated in outline as 39A. This archway connects the primary combustion chamber 2 with the extraction zone F and provides aerodynamic rounded corners in that region again for the purpose of reducing attack by the hot gases and in promoting gas and air flow thereover. The solid fuel will generally take up a position indicated very diagrammatically in outline by line G. This inclined surface of fuel therefore presents a large surface area to the extraction zone F.

It is seen that the extraction zone F is defined by a chamber having a relatively wide base 41 connected by a convergent gas flow path to a relatively narrow apex region 42. The relative surface areas of the base 41 and apex region 42 are such that a desired speed of the hot gases into the secondary combustion chamber 8 is achieved. A relatively low gas velocity is however provided through the relatively large surface area of fuel G. This relatively low gas velocity results in the solid fuel and particulate matter being left behind while the gaseous material from the fuel to be burnt up in the secondary chamber 8 is still able to be efficiently extracted.

The extraction zone F is, in the embodiment shown in FIGS. 1 and 2, defined as an upwardly directed conical chamber by a lower portion 43 associated with the primary chamber 2 being connected with an upper portion 44 associated with the secondary chamber 8. Respective flanges 45 connect the portions 43 and 44 together. As the zone F tapers upwardly toward the relatively narrow apex 42 a proportional increase in the gas flow speed results. Therefore the gas entering into the secondary combustion chamber 8 does so at a high speed.

However, in the region of the apex 42 a tuyere assembly 46 provides a flow of cold air which as indicated by the arrow H is transverse to the hot gas flow indicated by the arrow I. As the cold air through the tuyere assembly 46 is so much colder than the hot gas it is much denser, perhaps 3 or 4 times denser. This greater density together with its transverse direction of flow means that it becomes well mixed with the hot gas prior to the hot gas entering into the secondary chamber 8 so providing at least part of the oxygen needed to support the secondary combustion.

The angles of inclination of the internal walls of zone F indicated by letters $\alpha$ and $\theta$ may in one embodiment be of the order of 65° to 75° and 55° to 75° respectively and are not necessarily equal.

The tuyere assembly 46 is shown in FIG. 2 having at its bottom end an air manifold 47 which will be connected to one or more external air vents 48 through which external air will be induced into the manifold 47.

Figure 3:
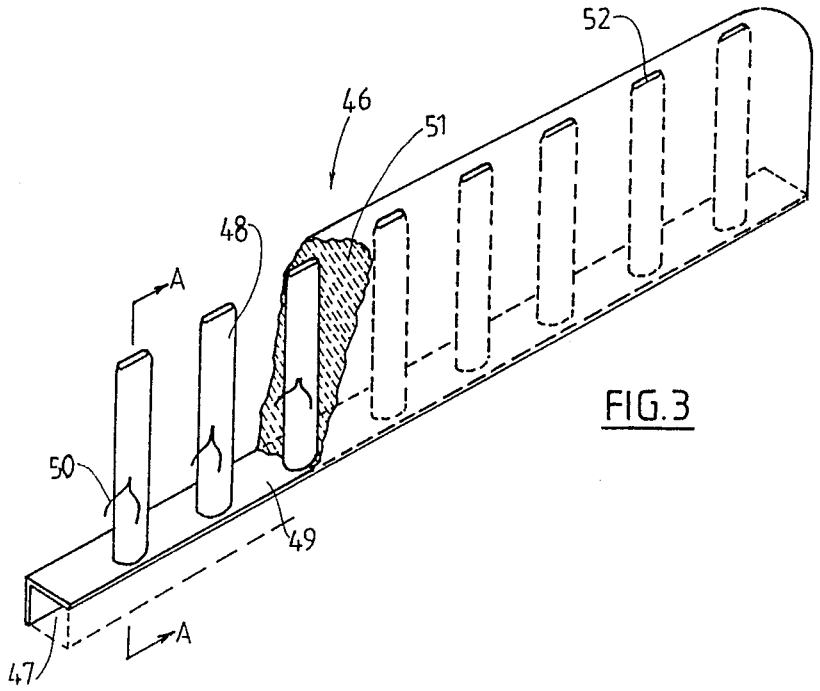
FIG. 3: shows very diagrammatically a part cross-sectioned view of the tuyere rack used in the solid fuel burner of the preceding Figures. Part of the refractory material is broken away so as to show in full line some of the tuyeres and the refractory engaging wires provided on those tuyeres.
Figure 4:
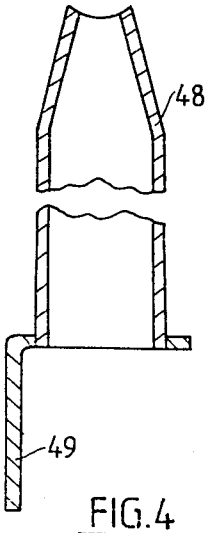
FIG. 4: is a view along arrows A—A of FIG. 3 showing a cross-section through one of the tuyeres and the tuyere rack.

As seen particularly from FIGS. 3 and 4, the tuyere assembly 46 has a plurality of tuyeres 48 mounted on an angle cross-section member 49 which will form, as illustrated diagrammatically in outline in FIG. 3, part of the manifold 47. Each of the tuyeres 48 is shown flattened towards its upper air outlet end 52 and having wire projections 50 which will facilitate the moulding about the tuyeres 48 of refractory material 51. This refractory material 51 will be smoothed over but leaving the open upper ends 52 of the tuyeres exposed. The top part of the tuyere assembly 46 provides part of the rounded aerodynamic corner of the apex region 42 leading from the zone F into the secondary chamber 8. The positioning of the top part of the tuyere assembly 46 relative to the apex 42 may be such as to give an angle of about 70° between the flow of hot gas and the flow of cold air H from the tuyere assembly 46.

The hot gas is accelerated through the zone F and therefore enters the secondary combustion chamber 8 at high speed. The rotatory, substantially circular path of the hot gases in the chamber 8 creates a vortex by centrifugal action. This ensures that the lighter high temperature gases are suspended in the centre of the combustion chamber 8 with the heavier cooler gases being entrained about the internal wall of the combustion chamber 8. This ensures a lower refractory wall temperature and increases the effective life of the refractory wall.

The rotation of the gases in the secondary chamber 8 is also desirable so that the hot gases leaving the secondary combustion chamber 8 can if required be discharged into an axial separator. Such a separator relies on the centrifugal effect on the particles in the hot gas discharge to enable these particles to be separated out and thus achieve a clean gas discharge.

The secondary chamber 8 is shown in FIG. 1 having a hot gas discharge outlet 9 through which hot gas is illustrated leaving by arrows K. A fan may generally be connected with the outlet 9 either directly or indirectly so as to induce the flow of air and gaseous fuel through the burner 1 and the hot gas through the discharge outlet 9.

On the other side of the secondary chamber 8 is shown a flap 10 through which air can be induced into the secondary chamber 8. The flap 10 is shown positioned substantially centrally of the secondary chamber 8 so as to be aligned with the vortex created in the secondary chamber 8. The air induced within the secondary chamber 8 through the opened flap 10, is colder and is thrown outwardly by centrifugal force to mix with the spinning hot gas. This enables a complete combustion to be achieved in the secondary chamber 8.

The gaseous fuel entering the secondary chamber 8 may be at a temperature in excess of 900° C. while in the secondary combustion chamber 8 the hot gas may develop an ultra high temperature possibly up to 1500° C. The hot gas exiting the outlet 9 may be utilised for direct heating and drying applications or may be mixed with tertiary air as required for lower temperature applications or introduced to heat exchange equipment.

The cross-sectional area defined by the apex region 42 may be such that it is larger than may be required in all situations to which the burner 1 may be put. It may therefore be desirable to reduce the volume of hot gas passing through the apex 42 and this may be achieved as shown in FIGS. 5 and 6.

Figure 6:
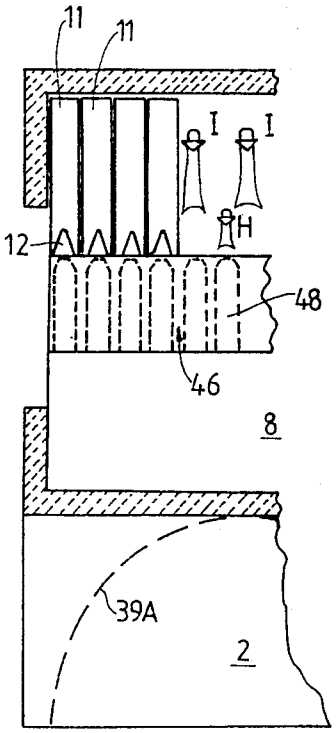
FIG. 6: is a very diagrammatic partial cross-sectional view along arrows B—B of FIG. 5 showing several of the refractory inserts in position as well as, in outline, the tuyeres aligned with respective refractory inserts.
Figure 5:
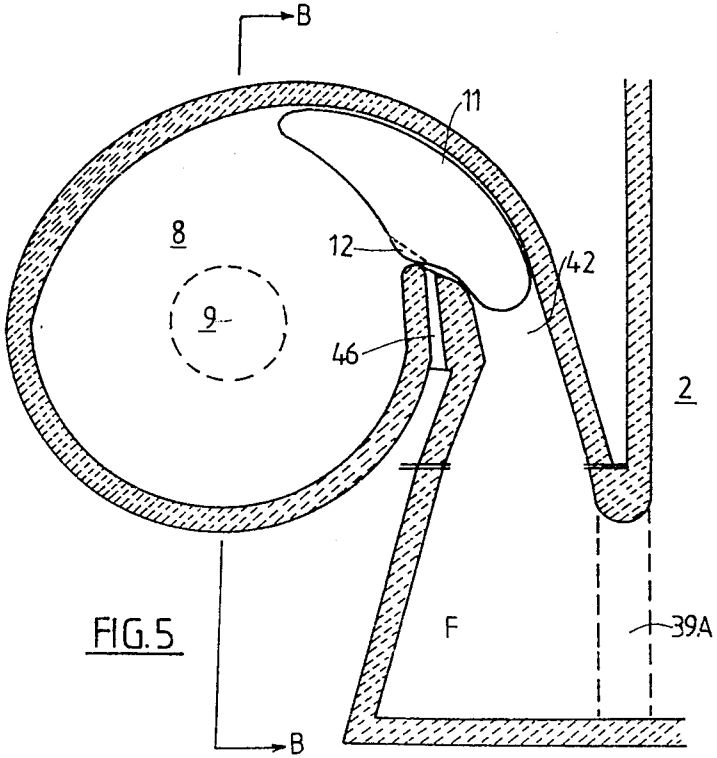
FIG. 5: is a very diagrammatic cross-sectional view of the secondary chamber of the preceding Figures but with the addition of refractory inserts which will modulate the flow of gasified fuel from the extraction chamber into the secondary chamber.

As seen in FIGS. 5 and 6 the primary combustion chamber 2 is connected through connecting archway 39A, extraction zone F and apex 42 with secondary combustion chamber 8. To reduce the cross-sectional area of the apex 42 a number of blocks 11 of refractory material may be positioned as shown. These can extend from the secondary chamber 8, over the tuyere assembly 46 and into the apex 42. As many blocks 11 of refractory material as may be required can be positioned in this manner. The relatively heavy weight of the blocks 11 together with their approximation to the internal surfaces about the entry into the secondary combustion chamber 8 and about the apex 42 can be sufficient to hold the blocks 11 in their desired position as shown. So as to not prevent the flow of air through the tuyere assembly 46 (the tuyeres 48 being shown in outline in FIG. 6) the blocks 11 are shown provided with air inlet nozzles 12 in the form of scooped out portions along the inner edge of each of the blocks 11 which coincide with the positioning of the open upper ends of the tuyeres 48.

In the embodiments of the invention described above it will be seen that the disadvantages of known solid fuel burners are overcome or at least obviated in that a relatively low gas velocity from the primary chamber can be utilized through a relatively large surface area of fuel which maximises the extraction of gaseous components from the fuel without also taking up particulate material. The substantially conical extraction zone can then still enable a sufficiently high gas velocity into the secondary combustion chambers to be achieved.

Although this invention has been described by way of example and with reference to possible embodiments thereof it is to be understood that modifications or improvements may be made thereto without departing from the scope or spirit of the invention as defined in the appended claims.

I claim:

1. A burner having a substantially vertical primary combustion chamber for receiving at its upper end a combustible fuel to be gasified and connected at its bottom end with a secondary combustion chamber to receive the gasified fuel from the primary combustion chamber and in which secondary combustion chamber the gasified fuel is further combusted, a substantially conical and vertical extraction zone providing a convergent gas flow path between said bottom end of said primary combustion chamber and said secondary combustion chamber, an apex region of said extraction zone being substantially open and leading into said secondary combustion chamber, an exit for hot gas being provided for said secondary combustion chamber, means for providing a substantially lateral and low velocity gas flow through said fuel at said bottom end of said primary combustion chamber and into said extraction zone where said gas rises substantially vertically in said extraction zone so that the low velocity of said gas combined with gravity separates out and holds back particulate matter entrained in said gas, said convergent gas flow path increasing said gas velocity at said apex region as said gas enters into said secondary chamber.

2. A burner as claimed in claim 1 wherein a cold air inlet means is provided at or adjacent said apex region so as to introduce into hot gas passing through said apex region a flow of cold air substantially transverse therewith.

3. A burner as claimed in claim 2 wherein said cold air inlet means comprises a plurality of tuyeres having their respective open upper ends opening into or adjacent said apex region and having their respective open lower ends connected with a cold air inlet manifold.

4. A burner as claimed in claim 3 wherein said extraction zone is defined by inner walls inclined to the horizontal at a respective angle of between 55° and 75°, and said tuyeres are directed at an angle of about 70° relative to an upper part of one of said inner walls in said apex region.

5. A burner as claimed in claim 2 wherein one or more blocks of refractory material are positioned within said apex region and extend into said secondary chamber, a lower surface of the or each block having an air inlet nozzle to coincide with an air discharge from said cold air inlet means.

6. A burner as claimed in claim 1 wherein said hot gas within said secondary chamber is constrained to move in a substantially circular path to create a vortex at a substantially central portion thereof, said secondary chamber hot gas exit is on one side of said secondary chamber at a substantially central portion thereof and further cold air inlet means is provided on an opposite side of said secondary chamber at a substantially central portion thereof to introduce cold air into said hot gases at said vortex.

* * * * *